United States Patent [19]

Croley

[11] Patent Number: 4,516,692

[45] **Date of Patent: * May 14, 1985**

[54] DISPOSABLE CONTAINER ASSEMBLY FOR LIQUIDS OR SEMI-LIQUIDS IN BULK

[75] Inventor: Thomas E. Croley, Worthington, Ohio

[73] Assignee: Williamette Industries, Inc., Delaware, Ohio

[ * ] Notice: The portion of the term of this patent subsequent to Dec. 20, 2000 has been disclaimed.

[21] Appl. No.: 470,274

[22] Filed: Feb. 28, 1983

Related U.S. Application Data

[63] Continuation-in-part of Ser. No. 349,696, Feb. 17, 1982, Pat. No. 4,421,253.

[51] Int. Cl.[3] ..... B65D 35/14

[52] U.S. Cl. ..... 222/105; 222/131; 222/185; 222/541; 220/403; 220/446

[58] Field of Search ..... 220/402, 403, 404, 408, 220/410, 446, 462; 206/453, 586, 597, 600; 229/41 C; 53/399; 222/80, 81, 83, 89, 92, 105, 107, 129, 130, 131, 173, 180, 185, 541

[56] References Cited

U.S. PATENT DOCUMENTS

| | | | |
|---|---|---|---|
| 2,658,614 | 11/1953 | Van Patten | 206/597 X |
| 2,720,998 | 10/1955 | Potter | 222/105 |
| 2,738,058 | 3/1956 | Hansen et al. | 206/600 X |
| 3,081,911 | 3/1963 | Scholle | 222/105 X |
| 3,108,732 | 10/1963 | Curie et al. | 229/14 |
| 3,138,293 | 6/1964 | Roak et al. | 222/105 |
| 3,173,579 | 3/1965 | Curie et al. | 222/105 |
| 3,370,774 | 2/1968 | Hopf | 220/403 X |
| 3,512,808 | 5/1970 | Graham | 285/205 X |
| 3,563,448 | 2/1971 | Croley | 229/23 |
| 3,937,363 | 2/1976 | Anderson | 222/105 |
| 3,937,392 | 2/1976 | Swisher | 229/41 C |
| 3,972,454 | 8/1976 | Croley | 222/541 |
| 4,022,258 | 5/1977 | Steidley | 222/81 X |
| 4,042,164 | 8/1977 | Croley | 229/23 BT |
| 4,076,147 | 2/1978 | Schmit | 222/105 X |
| 4,171,745 | 10/1979 | Zicko | 220/410 X |
| 4,240,565 | 12/1980 | Croley | 222/105 |
| 4,322,018 | 3/1982 | Rutter | 222/105 |
| 4,421,253 | 12/1983 | Croley | 222/105 |

FOREIGN PATENT DOCUMENTS

| | | | |
|---|---|---|---|
| 1025786 | 2/1978 | Canada | 220/403 |

*Primary Examiner*—Joseph J. Rolla
*Attorney, Agent, or Firm*—William V. Miller

[57] ABSTRACT

A disposable container assembly which is especially useful for containing, shipping and dispensing liquids or semi-liquids in bulk. It comprises a knocked-down fiberboard container body and end structure which can be set up on a pallet into a substantially rigid multi-sided polygonal drum-like container for receiving a flexible plastic bag that is to be filled with the substance to be dispensed. The bag is provided with a dispensing spout that is locked in dispensing position in one side of the fiberboard container to hold the bag in position in the container during filling, with its outer end exposed and which has a diaphragm type seal at its inner end. For dispensing, normally this seal is ruptured by a special cooperating probe which is inserted through the exposed outer end of the spout to withdraw the contents of the bag but in other cases the bottom of the bag can be ruptured directly through an opening in the pallet. The drum-like fiberboard container is secured in an upright position to the pallet by a stabilizing system so that twisting or tilting on the pallet will not occur and undue distortion or bulging of the relatively flexible fiberboard walls of the container will not occur as a result of surging of the contents tending to surge during shipping and handling. A spacer and baffle is provided between the upper end of the closed filled bag and the upper end structure to prevent upward surging with resulting distortion. The entire arrangement is such that it permits stacking of several of these container assemblies.

20 Claims, 22 Drawing Figures

DISPOSABLE CONTAINER ASSEMBLY FOR LIQUIDS OR SEMI-LIQUIDS IN BULK

This application is a continuation-in-part of copending application Ser. No. 349,696, filed Feb. 17, 1982, issued as U.S. Pat. No. 4,421,253 on Dec. 20, 1983.

BACKGROUND AND PURPOSE OF THE INVENTION

The invention relates generally to the provision of a relatively large fiberboard container assembly which is supplied in knocked-down form and is adapted to hold a flexible bag that will be filled, while in the container, with viscous or other semi-liquid or liquid, or other substance, as it conforms substantially to the shape of the semi-rigid container body and to the provision of means for dispensing the substance therefrom. U.S. Pat. No. 3,173,579 is an example of the general type of bag-in-box container, now generally used for packaging relatively small amounts of liquid, usually a maximum of five quarts for home or restaurant use. The bag usually has a dispensing valve and spout assembly on its upper end and the filling and dispensing occurs through the spout. The bag is usually first filled through the spout while outside the box, and is then placed completely within the box but sometimes is filled while in the box. Later its spout and valve assembly are manipulated to be exposed through an opening in the box wall for dispensing.

The present invention relates to a disposable flexible bag and fiberboard container assembly and cooperating devices which are particularly suitable for the containing for shipping and storage and, finally, dispensing, of various substances in bulk, particularly viscous substances such as glue, paint, molasses, etc., but also other semi-liquids or liquids. These substances are now commonly shipped in bulk in and dispensed from large returnable containers known in the art as "totes" and commonly containing three-hundred gallons or more. These containers are preformed rigid containers usually made of metal or fiberglass reinforced plastic, costly to produce, store and ship, and must be returned at a high freight rate and cleaned for re-use which obviously is expensive. The present invention makes it possible to use a disposable container, which is supplied in knocked-down form, but can be readily set up by one person to receive a bag that can be filled in place, within the container body, with the viscous or other substance in large volumes and from which it can be dispensed, as needed, all while the dispensing spout is locked in dispensing position. The fiberboard container forming part of this invention may be of the drum-like multi-sided polygonal type disclosed in U.S. Pat. Nos. 3,563,448, 3,972,454 and 4,042,164 so that it can be supplied in knocked-down form, but when set-up on a pallet to receive the flexible plastic bag for containing large volumes of the viscous or other substance, for example three hundred gallons, and is secured to and stabilized on that pallet, according to this invention, will have sufficient structural strength to retain the substance filling the bag during shipping, storage and dispensing. Thus, the use of preformed rigid metal or fiberglass-reinforced plastic "totes" will be avoided and the cost of shipping, storing, and freight for returning for cleaning for re-use of such containers will be eliminated. The container assembly of this invention is relatively inexpensive and is, therefore, disposable after one use although it could be knocked-down and most of the parts be re-used in some cases.

Although this invention will be described specifically as relating to the containing and dispensing of viscous substances, it is to be understood that it is not limited to such substances and is applicable to semi-viscous substances or liquids and other substances.

BRIEF DESCRIPTION OF THE INVENTION

According to this invention a multi-sided polygonal drum-like fiberboard container of the type disclosed in U.S. Pat. Nos. 3,563,448 and 4,042,164, set-up in upright position on a pallet, is provided for receiving a flexible plastic bag, for example a polyethylene bag, which is to contain the viscous or other substance to be shipped and dispensed. The bag is provided with a protruding dispensing spout at its lower end and preferably an upper open end. The spout preferably is sealed at its inner end by the wall of the bag. At a suitable location in the peripheral wall of the container body, adjacent its bottom, and in the overlapping flange of the tray-like bottom closure unit, aligning openings are provided and the spout on the bag is passed outwardly through these openings and is locked in place by special locking means. Thus, the spout has its outer end exposed and locked-in-place for dispensing, and may be provided with a removable cap, but its inner end is still sealed by the bag wall. Then, the bag can be filled from its upper end, as it is held in position within the fiberboard container, to occupy and conform substantially to the surrounding container body wall and be sealed, and a suitable fiberboard cap may be applied to the container top. Thus, it is not necessary to attempt to handle the large cumbersome bag, after filling, to position it in the fiberboard container and it is not necessary to attempt to manipulate the spout to later pull the spout through an opening in the container body for dispensing.

When handling and shipping large amounts of a liquid or semi-liquid substance in a relatively flexible fiberboard container of the type provided according to this invention, it is necessary to support and stabilize it so that it will not twist or tilt relative to the pallet and so that the forces created by the surging of the liquid or semi-liquid substance in the bag are resisted sufficiently to prevent excessive distortion and bulging of the container walls. This is accomplished, according to the present invention, by applying peripheral reinforcing to the tray-like bottom and to the container body, a non-surge spacer baffle arrangement in the space between the top of the filled bag and the cap, and a special clamping arrangement for clamping the upright drum-like container assembly to the pallet. This clamping arrangement includes a transverse stabilizing means in the form of a pressure-applying frame which is held in contact with the cap of the container by flexible tension members which extend vertically along the wall of the drum-like container body and are tightened around the pallet and frame to draw these members together so as to clamp the drum-like container body axially between the stabilizing frame and the pallet. These tension members are disposed at angularly-spaced positions, so as to resist radial thrusts, in various directions, created by surging of the substance in the bag during shipping or handling. This will prevent tipping and twisting of the container on the pallet and excessive lateral distortion of the fiberboard wall of the drum-like body of the container. In addition, the bag is filled only to a predetermined level, spaced from the cap of the container, so that, the spacer baffle arrangement prevents surging forces directly on the cap.

To dispense from the container, a special valve and probe assembly normally is applied to the locked-in-place spout and this assembly may be on a hose leading to a suitable pump. As the probe on the assembly is inserted into the spout, it will rupture the seal or diaphragm, at the inner end of the spout, and will frictionally seal within the spout so that the viscous contents of the bag can be withdrawn without leakage. An alternative way of dispensing is to rupture the bottom of the bag through aligning holes in the pallet and fiberboard bottom of the container.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
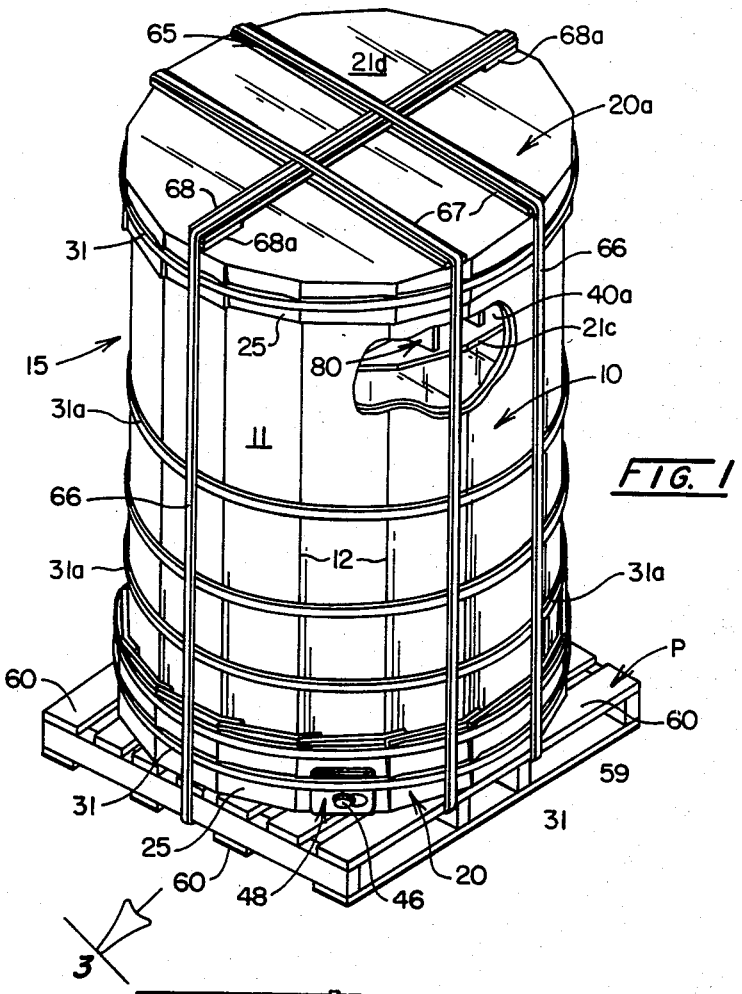
FIG. 1 is a perspective view, partly cut away, of a container assembly according to this invention.
Figure 2:
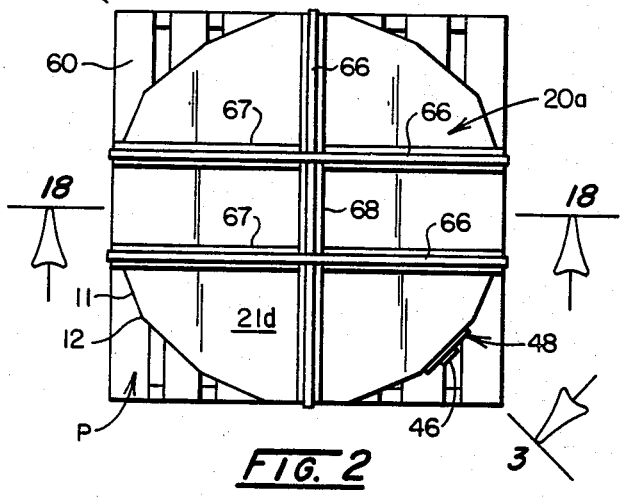
FIG. 2 is a plan view of the container assembly.
Figure 3:
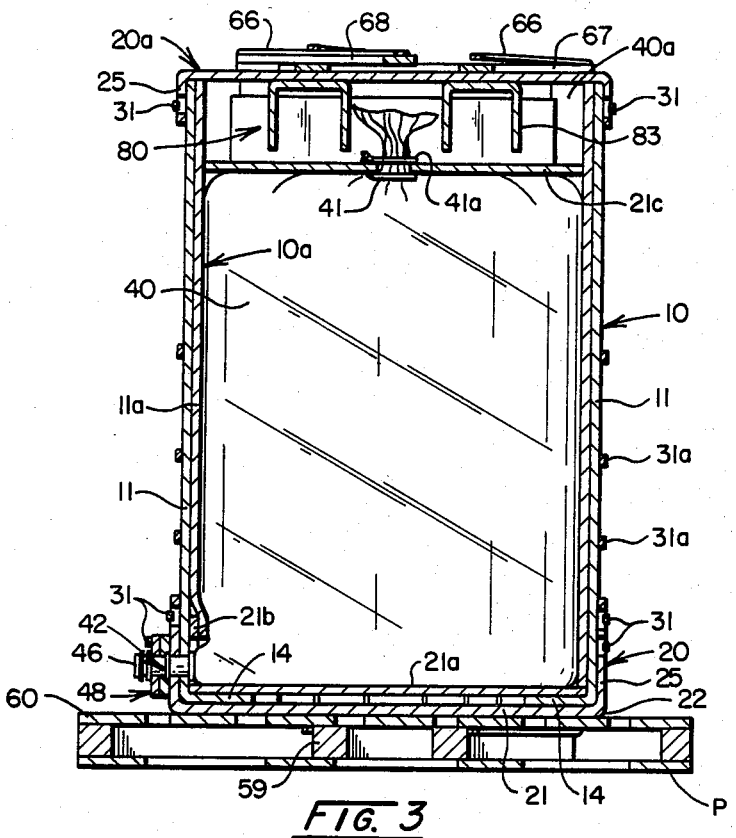
FIG. 3 is a vertical sectional view taken along line 3—3 of FIG. 2 diagonally through the assembly.

With specific reference to the drawings, the complete assembly of this present invention is illustrated in FIGS. 1–3, and the fiberboard container assembly 15 thereof is of the general construction disclosed in U.S. Pat. Nos. 4,042,164 and 3,563,448. The parts for the complete assembly are shown in FIG. 5 and the assembling thereof is illustrated in FIGS. 8–16. The fiberboard assembly 15 comprises a drum-like body 10 which is of multi-sided polygonal tubular form, open at both ends, and consisting of the sides 11 which are in the form of flat panels joined at the score lines 12 which extend the full length of the tubular body. As indicated in said patents and in FIG. 5, the body 10 is supplied in folded or knocked-down form and is then set up into upright polygonal tubular or drum-like form as shown in FIG. 1. A closure unit 20, described in said patents, telescopically receives the bottom end of the tubular body 10 and a similar one 20*a* telescopically receives the upper end of the body and serves as a top cap. The bottom unit 20 usually is made as a deeper tray compared to cap 20*a*. As disclosed in said patents, this closure unit comprises a flat substantially disc-like body 21 (FIGS. 3 and 4) which has an outer peripheral edge of polygonal outline where the flanges 25 connect thereto at the hinge lines 22. The flanges correspond in number to the panel sides 10 of the tubular body 10 and, in the example illustrated, this is sixteen. The closure unit 20 is supplied in flat or knocked-down condition (FIG. 5) but can be set up by one person with the flanges 25 perpendicular to the disc 21. When applied to the end of the body 10, each flange 25 will extend inwardly over the cooperating panel or side 11 and will be held in that position by preformed retaining bands 31 applied in vertically-spaced positions in the preformed notches 31*b* therein. The fiberboard container assembly 15 is supported by a pallet P, with the disc 21 of the bottom closure 20 resting thereon. According to this invention and as shown in FIGS. 1 and 2, the pallet P is of square form and its sides correspond substantially in length to the diameter of the container 15. It is preferably made of wood and its details of construction will be described later. The body 10 may receive a tubular fiberboard liner 10*a* which is of the same construction and form as body 10 but is slightly smaller so it can be slipped axially thereinto. As indicated, it includes the hinged panels 11*a* which correspond in number to panels 11 and fit tightly therearainst.

According to this invention, a large flexible bag 40 made of a suitable plastic, such as polyethylene, is provided within the expanded tubular liner 10*a* fitted within the expanded tubular body 10 of the container assembly. This bag is of sufficient size that, when filled with the viscous or other material, it will expand substantially to the contour of the surrounding liner 10*a* in the body 10 set-up on and inserted within the bottom closure 20, as indicated in FIG. 3. According to this invention, the filling is through the open top of the bag. However, the bag, according to this invention, is of such size that, when filled and the neck tied by a suitable tie 41, such as a cable-tie, there usually, depending upon the nature of the material remains a void or space 40*a* above its upper end between it and disc-like body 21*d* of the cap 20*a*, which receives a spacer-baffle 80 Cap 20*a* is substantially like bottom closure tray 20 but is more shallow and receives only one retaining band 31. The bag 40 is provided at its other or bottom end with a spout 42 which is exposed at the bottom end of the container assembly 15 and where it is locked to hold the bag in position within the container body for filling and subsequent dispensing. Additional reinforcing bands 31*a* are applied to the exterior of the container body 10 at vertically-spaced positions.

The spout 42 (FIGS. 4 and 12) is preferably of semi-rigid plastic and comprises an annular tubular body 43 which has an inner peripheral flange 44 that is heat-sealed to the wall of the bag 40. However, the wall of the bag normally extends over the inner end of the spout body 43 to provide a diaphragm seal 45 which may be subsequently ruptured to permit outward flow of the bag contents through the spout body. The body of the spout projects radially outwardly through aligning openings in the cooperating wall side panels 11 and 11*a* and overlapping flange 25 and will be exposed at its outer end where it may receive a snap cap 46 that is normally releasably held in place on the exposed projecting spout body end, having a retaining and locking groove 47 for receiving the spout extremity. A special locking means, indicated generally by the numeral 48, ensures that the spout will be retained in this projecting relationship to the overlapping flange and side wall during filling the bag 40 and subsequent emptying of it.

As indicated, the spout body 43 is of annular tubular form having the annular flange 44 at its inner end for heat-sealing to the wall of the bag 40. Formed on the exterior of the tubular body axially-outwardly of the flange 44 are the axially spaced peripheral retaining flanges or locking ribs 49 and 50. The flange 49 is spaced axially from the flange 44 a distance slightly greater than the thickness of the laminated wall formed by the overlapping panels or walls 11–11*a* and 25. The axial outward spacing of the flange 50 from the flange 49 is slightly more than the combined thickness of several laminations of elongated fiberboard locking panels 51 which are part of the locking means. Two panels 51 are shown but different numbers or only one of the panels could be used.

Figure 4:
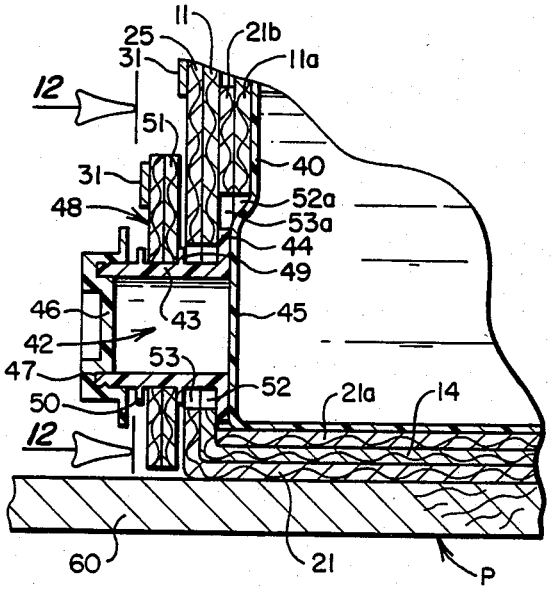
FIG. 4 is an enlarged vertical sectional view showing the bag spout locked in dispensing position.
Figure 5:
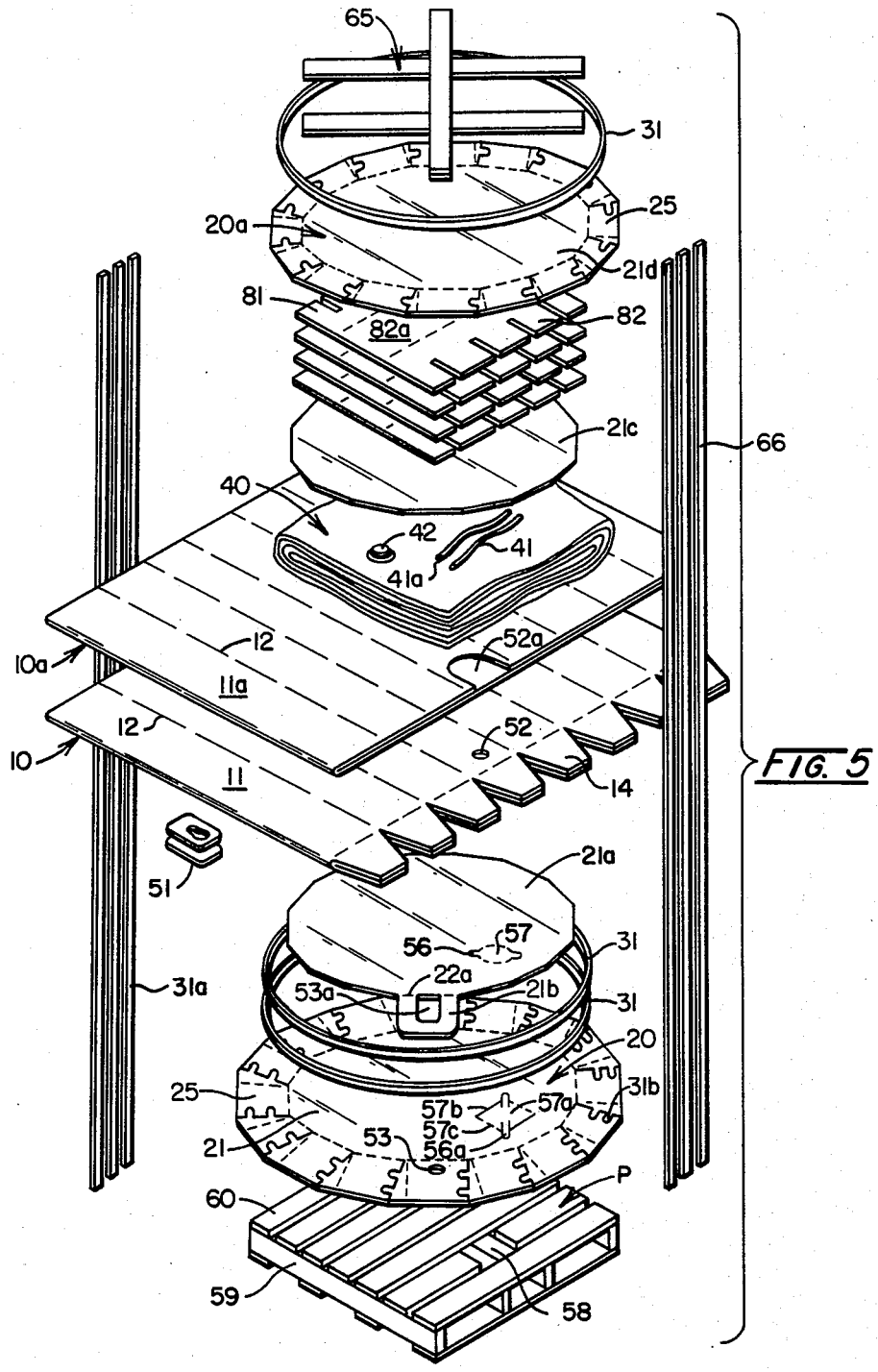
FIG. 5 is a perspective view showing the various parts used in the container assembly.

To permit projection of the spout 42 through the multiple wall of the container assembly 15 adjacent its bottom end, one of the panels 11 and cooperating upstanding bottom flange 25 are provided with aligning openings 52 and 53 and a cooperating downwardly-opening notch 52*a* is formed in the associated liner panel 11*a*, as indicated in FIGS. 4 and 5. The aligning openings 52 and 53 are of a diameter slightly larger than the projecting spout flanges 49 and 50 to permit the flanges to be passed axially outwardly therethrough, as indicated in FIG. 4, and notch 52*a* may be larger.

Each of the locking panels 51 (FIG. 12) is provided with a combination opening 54 similar to a keyhole opening so that it will permit passage of the spout 42 therethrough when a locking panel is in one longitudinal position but prevent passage therethrough when the panel is in another longitudinal position. This combination opening includes a larger part 54*a*, which is formed as a part-circular opening and a smaller communicating opening 54*b* which is formed as an overlapping part-circular opening. The diameter of the opening part-circle 54*a* is slightly greater than that of each of the locking flanges 49 and 50 and the same as that of each of the openings 52 and 53 and the diameter of the smaller part-circular opening 54*b* is slightly greater than the outer diameter of spout body 43 but less than that of the locking flanges 49 and 50. Each of the part-circular openings is greater than a semi-circle but less than a full circle to produce a pair of slightly yieldable locking projections 55, which extend inwardly towards each other and are slightly curved at their extremities. The distance between the extremities of projections 55 is slightly less than the outer diameter of spout body 43.

To lock the spout 42 in the indicated projecting position, the locking panels 51 are reversed longitudinally and superimposed with their larger opening parts 54*a* in alignment. This will permit movement of the spout body 43 axially outwardly therethrough, since the flange 49 and 50 will be of lesser diameter and will pass readily therethrough. Then, the panels 51 are moved longitudinally in opposite directions to align them which will also align the smaller opening parts thereof while positioning them around the spout body 43 and between the locking flanges 49 and 50. The spout body will pass laterally between projections 55 which will first yield slightly to permit this passage and then snap into place around the spout body. Since the flanges 49 and 50 are of greater diameter than the aligning smaller opening parts 54*b*, they serve as stop shoulders to prevent axial movement within the locking panels 51. The inner locking panel, consequently, will engage the outer surface of the flange 25, as shown in FIG. 4, to keep the spout 42 in projecting dispensing position. The panels 51 will be centered longitudinally on the spout (FIG. 12) and may be stapled or otherwise secured together. The bottom of bag 40 may rest on a bottom liner disc 21*a*, which is supported by flanges 14 of the body 10, and upon which the lower edge of liner 10*a* rests, as shown in FIG. 3. This disc has an angular peripheral edge of polygonal form corresponding to the expanded tubular body 10. On one of the straight edges corresponding to a panel 11 it is provided with a locating tab 21*b* which initially is radially disposed (FIG. 5) but can be bent upwardly vertically about a score line 22*a*. This tab is provided with a spout-receiving radial slot 53*a* which is of a width the same as the diameter of spout-receiving openings 52 and 53 in the respective panel 11 and flange 25. This tab 21*b* when bent upright (FIG. 4) is disposed between members 11 and 11*a* and receives and cooperates with the spout 42 to locate the disc 21*a* at a predetermined angular position within the body 10 so that the tear-out part 57 thereof aligns with tear-out part 57*a* of disc 21.

As will appear later, the contents of the container may be removed through a probe which will rupture the diaphragm seal 45 provided by the bag at the inner end of the spout 42. However, in some instances, it may be desirable to remove the bag contents by directly rupturing the bottom of the bag by inserting a cutting member through an opening in the pallet P and aligning openings in the fiberboard bottom disc 21 and 21*a*. To create the opening in disc 21*a*, that disc is provided with pullout tabs 56 (FIGS. 5) formed by slits at diametrically opposed points on a circular perforated tear-out disc 57. The opening in disc 21 will be created by a substantially square formation 57*a* provided by slits 57*b* and scored hinge lines 57*c*. This square formation is greater across than the diameter of tear-out 56. It is provided with diagonally-extending slit tabs 56*a* at two corners. As shown schematically in FIG. 19A, a piece of filament tape 57*d* is extended diagonally over 57*a* and tabs 56*a* thereof. For dispensing from the bottom, the projecting diagonal tabs 56*a* are pulled downwardly creating a diagonal tear or slot completely across the square tear-out portion 57*a* of disc 21 so that two triangular portions 57*e* (FIG. 20) can be bent downwardly to expose the inner circular tear-out portion 57 in disc 21*a*. Then this circular tear-out portion can be removed by engaging the radially-projecting tabs 56 to expose the bottom of bag 40 which can then be ruptured.

Figure 6:
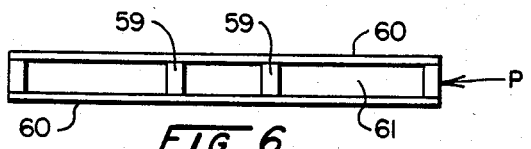
FIG. 6 is an end view of a pallet used in the assembly.
Figure 7:
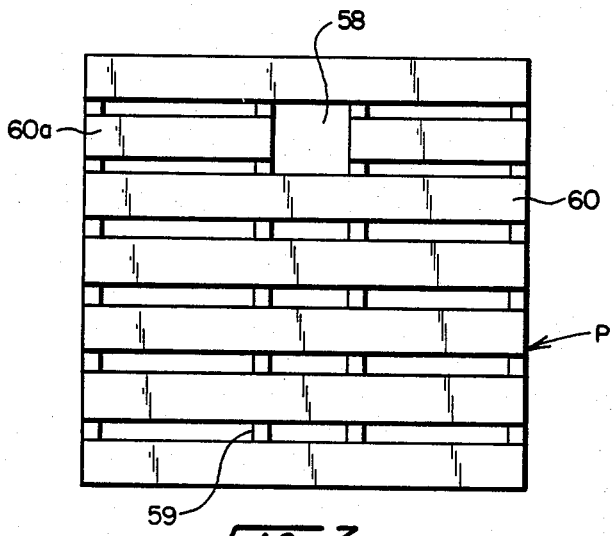
FIG. 7 is a plan view of the pallet.
Figure 8:
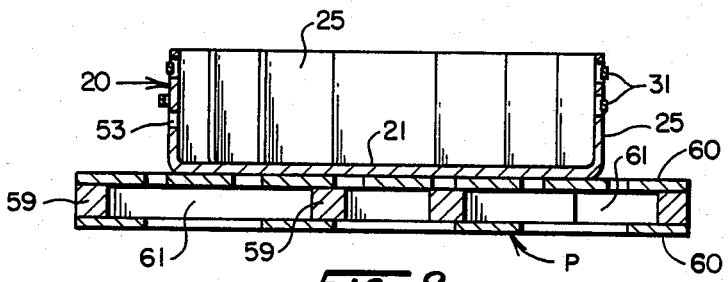
FIG. 8 is a vertical sectional view showing the bottom tray or closure on the pallet.

The pallet P is provided with an opening 58 for exposing the tear-out disc 57 in the fiberboard bottom disc 21. This pallet as shown in FIGS. 6 to 8 is of special formation according to this invention having the support rails 59 which include an inner pair spaced apart to allow for the opening 58. Transverse slats 60 are attached in parallel relationship to the top edges of the rails. Similar slats are attached to the bottom edges of the rails with some of the top slats 60*a* being short and the lower ones being properly spaced to provide the opening 58. Fork-receiving pockets 61 are provided at each side of the pallet between pairs of rails 59.

According to this invention, the fiberboard assembly 15 so far described, is secured to the pallet P by a special arrangement so that the fiberboard container will not twist or tilt relative to the pallet as a result of forces resulting from handling and shipping, and undue distortion or bulging of the relatively flexible fiberboard walls of the container will not occur as a result of forces produced by surging of the liquid or semi-liquid contents during shipping and handling. This arrangement, in use, is shown best in FIG. 1 and it consists basically of an upper stabilizing means shown as a pressure-applying unit or frame 65 which is secured in flat contact with the cap 20*a* by a plurality of angularly-shaped tension members 66 which extend in vertical planes, completely around the frame and pallet P and the fiberboard container assembly 15 disposed therebetween. The body 10 of the fiberboard container has its opposed ends telescopically fitted within the tray-like bottom closure 20 and cap 20*a* and this assembly is clamped axially on the pallet P by the tension members 66 after they are passed completely vertically around this assembly as indicated. The tension members 66 are preferably in the form of steel bands but may be other tension members which can be drawn around the assembly and secured in tightened condition.

As indicated, the pallet P is of special form and the form is designed to receive and properly position the tension members 66. The pallet as shown is of square form and its sides are of a length substantially the same or slightly greater than the transverse dimension of the body 10 of the almost circular tubular fiberboard container, which might be termed its diameter, but actually is the transverse axis or distance between two directly opposed panels 11. The pair of support rails 59 at the center of the pallet are spaced apart a distance slightly greater than the width of a panel 11.

The frame 65 is of substantially H-form and consists of a pair of substantially rigid slats 67 disposed in parallel relationship in flat contact with the disc 21 of the cap and a single slat 68 extending at a right angle thereto and over the slats 67 preferably being fastened thereto. The slats 67 are spaced apart just slightly more than the two center rails 59 of the pallet and project slightly outwardly beyond the associated central panel 11 at each of their ends at the respective hinge joints 12. The single slat 68 projects slightly outwardly beyond the outer faces of the associated opposed panels 11 and has leveling blocks 68*a* at its opposite ends of the same thickness as slats 67.

A single tension band 66 is passed over slat 68 of stabilizing frame 65 and under the rails 59 of the pallet P between lower slats 60. A band is passed over each slat 67 of frame 65 and through the pallet just outwardly of the corresponding rail 59. These bands will be disposed in parallel relationship and will pass vertically along the opposed center panels 11 just outwardly of hinge joints 12. The other single tension band 66 will pass vertically along the center line of each of the opposed center panels 11 at its face. Thus, three tension bands are shown at angularly-spaced positions in vertical planes at right angles for resisting forces in at least two radial directions. However, more tension members may be provided at other angularly-spaced positions.

Figure 16:
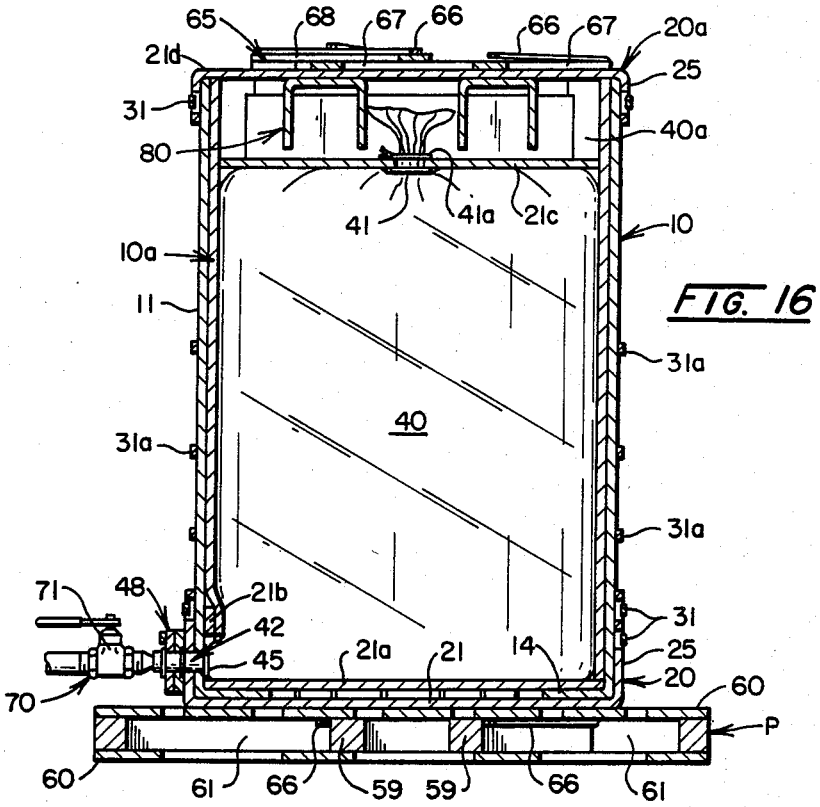
FIG. 16 is a similar view showing the clamping arrangement applied to the assembly and the probe being inserted for dispensing.
Figure 17:
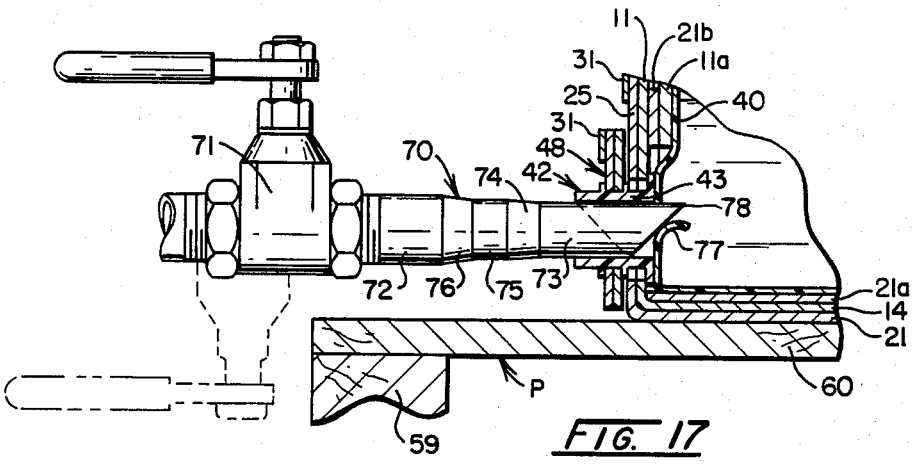
FIG. 17 is an enlarged vertical sectional view showing the spout seal made by the bag being displaced by the probe.

The valve and probe assembly which may be used in removing the contents of the container and bag assembly is indicated generally by the numeral 70 in FIGS. 16 and 17. It may be mounted on the end of a hose connected to a suitable pump for withdrawing the viscous material from the bag 40. It can be provided with any suitable shut-off valve 71. The probe itself is an annular tube, preferably of metal, which has an outer cylindrical tubular portion 72 (FIG. 17) connected to the valve 71, an intermediate portion, and a lesser diameter forward or leading diaphragm-rupturing tubular portion 73. The intermediate portion preferably includes a leading tapered guide surface 74, a following cylindrical sealing-surface 75 of substantially the same diameter as the internal diameter of spout body 43, and a tapering sealing surface 76 joining surface 72 and 75. The forward or outermost extremity of portion 73 is cut at an angle to form an angled edge 77 with a penetrating point 78. The outer diameter of portion 73 is slightly less than the inner diameter of the spout body 43. The diameter of the intermediate sealing portion 74 at its forward end is less than the internal diameter of the spout body but at its rear end is greater than the internal diameter of the spout body.

The fiberboard container assembly 15 is so disposed on the pallet P that the spout 42 is at an exposed corner of it, as indicated in FIGS. 1, 16 and 17. The valve 71 will have its stem axis upstanding when the point 78 on the probe is upwardly as indicated in FIG. 17. When the probe is being inserted in the spout, as indicated in FIG. 16, it will be over the pallet corner extension. If the probe 70 is rocked in either direction from this position the body of the valve 71 will contact the pallet to prevent insertion. This will prevent the sharp point 78 from being below the axis of the probe when it is inserted. It has been found important to keep it in an upper position so it will rupture the bag seal 45 downwardly as indicated in FIG. 17. If point 78 is in the lowermost position, it tends to lift and rupture the bottom of the bag and cause leakage around the probe.

As indicated, when the bag 40 is filled, its upper tied end is below the disc 21*d* of applied cap 20*a* to provide the space 40*a* above the bag between it and the cap. A disc 21*c* may be used over the tied upper end of the bag and it will be similar to the lower disc 21*a* which may be used over the bottom disc 21 beneath the lower end of the liner 10*a*. However, this disc 21*c* is provided with a central opening through which the gathered end of the bag is passed. A second tie 41*a* is preferably applied above this disc, which disc is adapted to apply pressure to the upper end of the filled bag.

Figure 14:
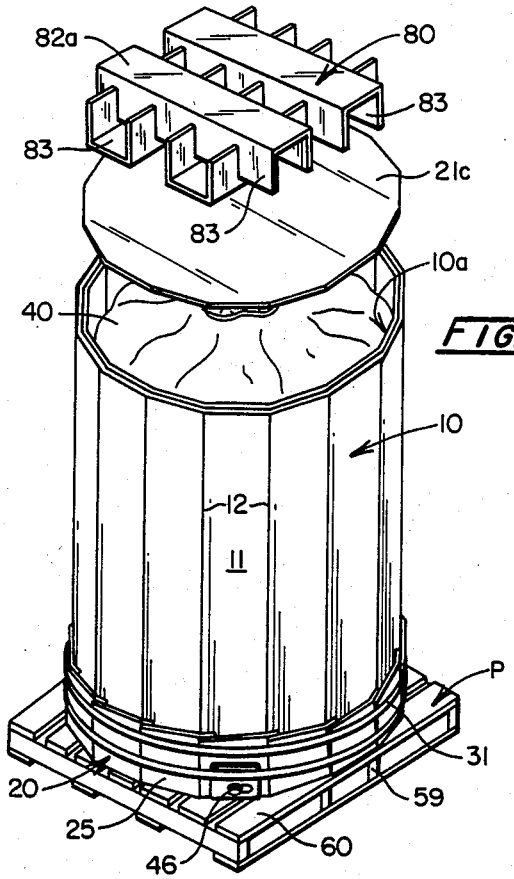
FIG. 14 is a vertical sectional view showing the filled bag in the container body and a top pad and spacer baffle being inserted.
Figure 15:
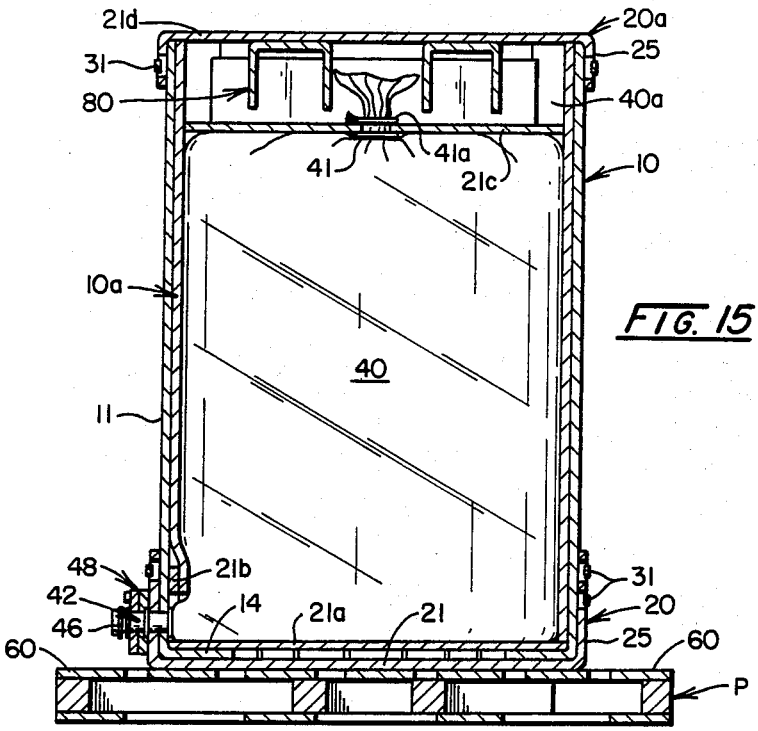
FIG. 15 is a similar view showing the pad and spacer baffle in position over the top of the bag with the cap also in position on the container body in engagement with the spacer baffle.

The space 40*a* receives a spacer-baffle, indicated generally by the numeral 80, which is of such formation and so positioned as to prevent upward surging of the liquid at the closed upper end of the bag 40 towards the disc 21*d* of the cap 20*a* which might cause bursting of the upper end of the bag or distortion thereof to apply undue force to the cap 20*a*. *This spacer-baffle 80 is made of four identical blanks 81 which are shown in FIG. 5 and each of which has a central panel 82a,* formed by score lines, with a plurality of leg-forming tabs 82 extending outwardly therefrom in both directions formed by parallel slits. To assemble the blanks 81 into unit 80, the legs 82 are bent outwardly about the score lines, as indicated in FIG. 3, to produce U-shaped channel-like structures 83 which are disposed in laterally-spaced pairs vertically-reversed and interlocked at the slits (FIGS. 3 and 14). This produces a spacer unit 80 which is of sufficient rigidity axially or vertically to take the compressive stresses created when the liquid tends to surge in the bag 40 against the disc 21*c*, since the spacer 80 will be tightly clamped between the disc 21*c* and the cap disc 21 and will, in effect, act as a baffle to preclude upward flow or surge of the liquid in the bag.

The bands 31 are preferably preformed and applied to the bottom tray-like closure 20 to hold the flanges 25 upright during insertion of the container body 10 therein. The lower ring 31 is applied in a position so that the spout-locking means 48 (FIG. 1) will be therebeneath. The other band 31 is applied above the first band close to the upper edges of upright flanges 25.

The body 10 itself is reinforced peripherally at selected vertical positions to prevent bulging by similar bands 31*a* which are extended around it and then have their ends joined. These bands 31*a* are applied at vertical intervals preferably up past the mid-point in the height of the container body. They are preferably drawn tight and secured around the body after the filling of the bag 40.

All the parts of the container assembly so far described are supplied to the user in knocked-down condition and can be set up expeditiously by one person. The complete group of parts for setting up one of these assemblies according to this invention is illustrated in FIG. 5. The manner in which the parts are successively assembled and the container is filled is indicated in FIGS. 8 to 16 and the manner in which dispensing from the container may occur is illustrated in FIGS. 17–20.

Figure 9:
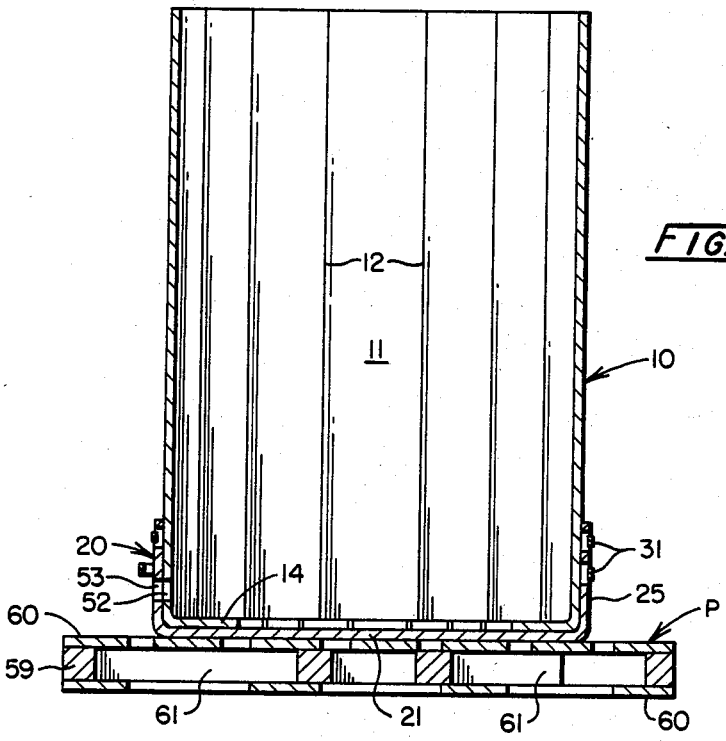
FIG. 9 shows the drum-like body of the container with its lower end inserted in the tray.

The bottom tray 20 is first set-up from the flat blank indicated in FIG. 5 to the condition illustrated in FIG. 8 with the flanges 25 upstanding and held in that position by the preformed circular bands 31. As indicated in FIG. 5, bands 31 are preformed into circular form and consequently, one person can gradually and successively turn up the flanges and apply the bands to hold them in upturned relationship. This formed bottom tray is then set on the pallet P, as indicated in FIG. 8, and is centered thereon with diametrically opposed pairs of flanges 25 being at the corresponding side edges of the square pallet and with the corners of the pallet exposed at its upper side. As indicated, sixteen upstanding flanges 25 are provided so that the tray is almost annular. The body 10 is next set up from the flat folded blank of FIG. 5 and its flanges 14 at its lower end are bent inwardly horizontally and then that lower end is inserted in the bottom tray 20, as indicated in FIG. 9. The horizontal flanges 14 will rest on bottom disc 21 which will rest on pallet P.

Figure 10:
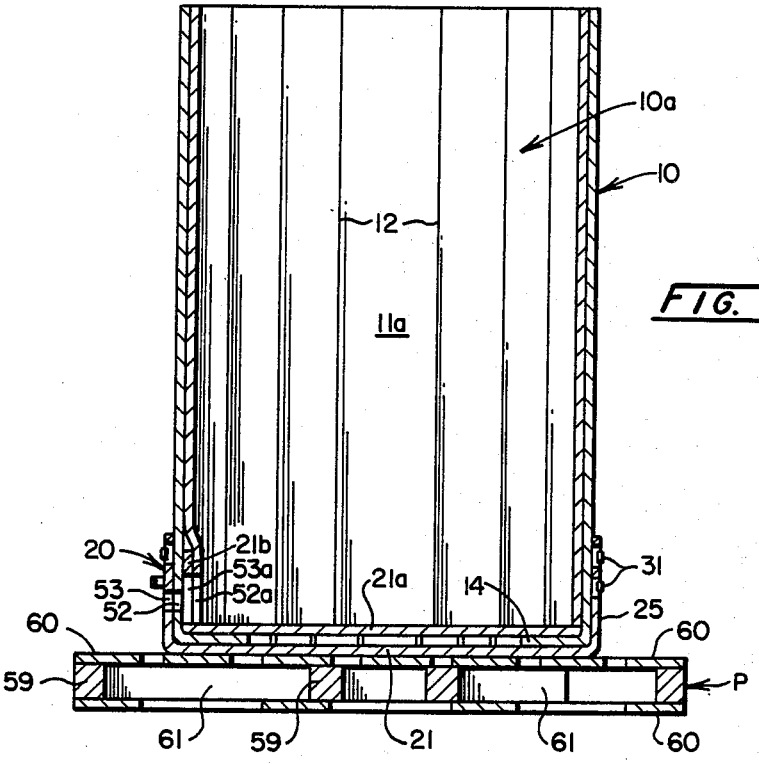
FIG. 10 is a vertical sectional view similar to FIG. 9 showing the fiberboard container assembly, with a body liner, ready to receive the bag.

If bottom liner disc 21*a* from the parts of FIG. 5 is used it is inserted in the body 10 and is allowed to rest on the horizontal flanges 14 as shown in FIG. 10. As indicated, this disc will have a peripheral edge of polygonal form corresponding to that of body 10 so that the edges will engage the vertical panels 11 of the body 10.

When it is desired to use the liner 10*a*, it is set up from the flat folded blank, indicated in FIG. 5, into tubular form and is inserted axially into the body 10 into the position shown in FIG. 10 where its lowermost edge rests on the bottom disc 21*a*, the vertically disposed panels 11*a* thereof being in flat contact with the corresponding panels 11 of the body 10. Both the tubular body 10 and tubular liner 10*a* will be open at their corresponding upper ends which will have their edges in horizontal alignment, as shown in FIG. 10. At this time, the bands 31 around the flanges 25, are tightened as much as possible.

Figure 11:
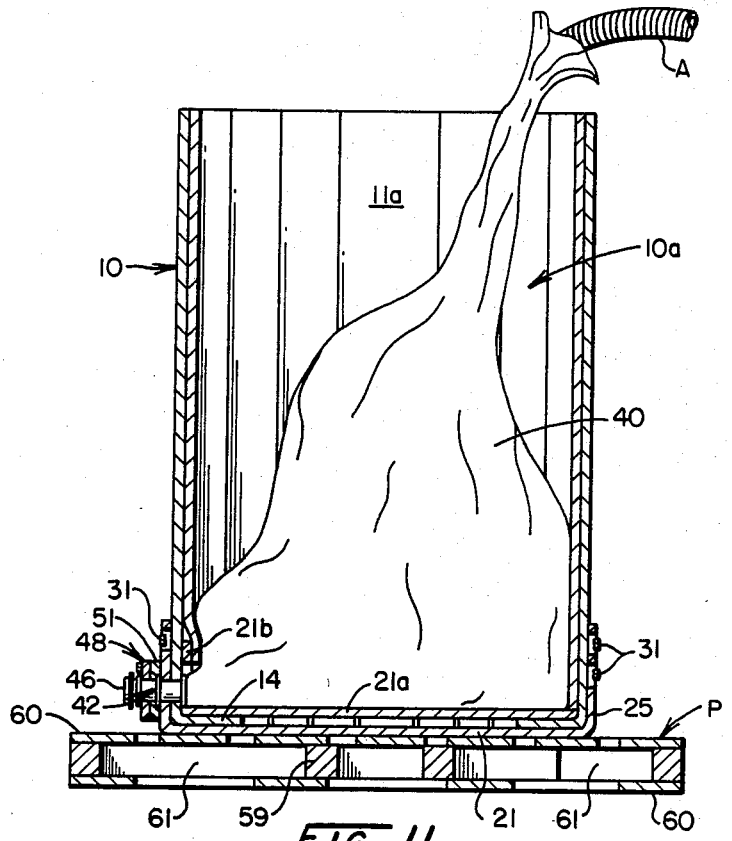
FIG. 11 shows the bag being expanded in the container body.
Figure 12:
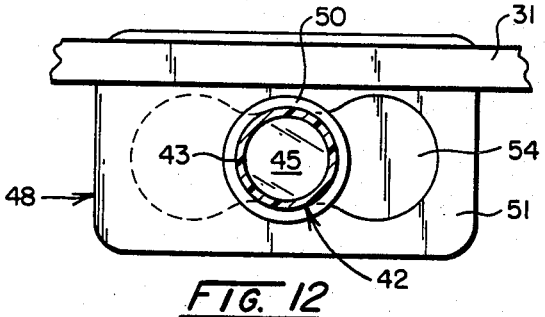
FIG. 12 is a sectional view taken on line 12—12 of FIG. 4.
Figure 12A:
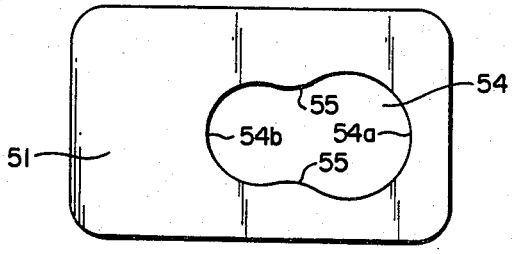
FIG. 12A is a face view of one of the spout-locking panels.
Figure 13:
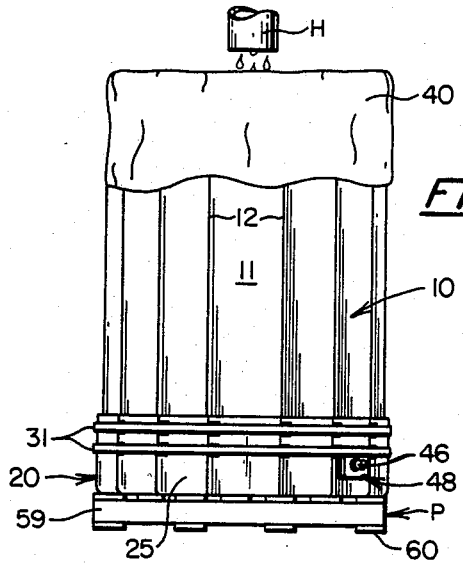
FIG. 13 is a side elevational view showing the bag being filled in place.

The plastic bag 40 is now unfolded and positioned in the lined container body, as indicated in FIG. 11, and is locked to the spout 42 by the panels 51 of the locking means 48. The bag is preferably expanded into contact with the liner 10*a* by means of an air hose A. The bag will be of sufficient length so that its upper end can be folded down over the outside panels 11 of the body 10, as shown in FIG. 13. Then, with the bag expanded into the wall of the fiberboard lining 10*a* of the fiberboard container body 10, it is filled with the liquid or semi-liquid by suitable filling means, the head of which is indicated at H in FIG. 13. Filling of the bag tightens the body against upstanding flanges 25 which are held in place by bands 31.

According to this invention, the plastic bag 40, however, is filled only to a level substantially below the upper edge of the container body 10. The top of the bag is gathered together and is tied by a suitable tie 41 as shown in FIG. 13 so that the top of the bag will be well below the top edge of the container body. The disc 21*c* is next inserted into the upper end of the liner 10*a* into contact with the top of the filled bag 40, the gathered end of the bag being passed through its central opening and a second tie 41*a* may be applied above disc 21*a*. Then the spacer-baffle assembly 80 is formed as previously indicated from the flat banks 81 and is inserted into the space 40*a*, the U-shaped formation 83 thereof obviously being of a length to permit this. Next, the cap 20*a* is formed from the flat blank of FIG. 5 and is positioned over the upper end of the body 10 with the depending flanges 25 extending down over the exterior of the corresponding panels 11. Thus, spacer-baffle 80 will have its lower panel surface 82*a* resting on disc 21*c* and the cap disc 21*d* will be in engagement with the upper panel surfaces 82*a* thereof. The previously applied band 31 on this cap 20*a* will not yet be completely tightened. The reinforcing bands 31*a* from FIG. 5 are applied around the lower portion of the exterior of the body 10 at vertically-spaced levels at least up beyond the mid-point in the height of the body and are tightened. Band 31 on cap 20*a* is also tightened (FIG. 16).

According to this invention, the filled, closed fiberboard container assembly is then stabilized on the pallet P which carries it. This is done by first applying the substantially rigid stabilizing or H-frame 65 from FIG. 5 in flat contact with the upper surface of the disc 21*d* of the cap 20*a* and then passing the three tension bands 66 of FIG. 5 vertically around the frame 65 with pallet P, and the fiberboard container assembly 15 axially therebetween, and tightening them, to hold these members axially together, the final assembly appearing as illustrated best in FIG. 1.

This stabilizing arrangement will prevent tilting or twisting of the flexible container assembly 15 on the pallet P as a result of radial forces from various angular directions which result during shipping and handling.

Radial surging of the liquid in the bag 40 will result in radial forces which will be resisted by the tension members 66 along with reinforcing rings 31*a* and will prevent undue distortion of the container panels, although some of the forces will be absorbed by the relatively flexible fiberboard container panels. The disc 21*c* will be clamped tightly against the upper end of the filled bag 40 by the spacer-baffle 80 which is beneath the cap disc 21 and may be considered part of the cap assembly. This will serve as a baffle to prevent upward surging of the liquid in the bag which would otherwise create upward axial forces to act on the cap disc 21. Because the entire assembly 15 is stabilized and can take compressive or axial forces it is even possible to stack several of these assemblies.

The contents of the container may be dispensed in either of two ways as previously described. The probe 70 is normally used in this dispensing operation, as shown in FIGS. 16 and 17. When the probe is inserted through the spout (FIGS. 16 and 17) its pointed end 78 pierces the seal 45 and forces it downwardly out of the way. The oval angular end of the probe being of greater area than the ruptured disc-shaped seal cannot thereafter accidentally cover and seal the probe end. The tapered surface 74 of the probe will engage with and seal at the end of spout body 43, even if there are slight variations in it. Then flow of the bag contents can be controlled by the dispensing valve 71.

Figure 18:
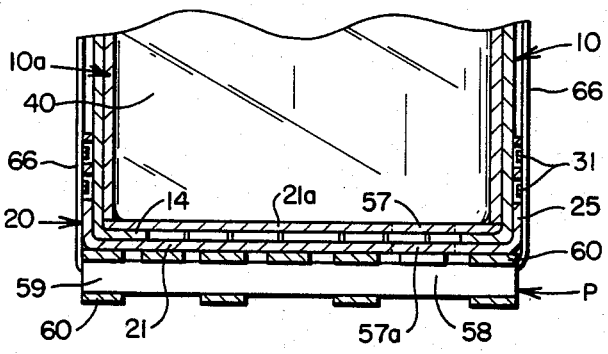
FIG. 18 is a vertical sectional view taken along line 18—18 of FIG. 2.
Figure 19:
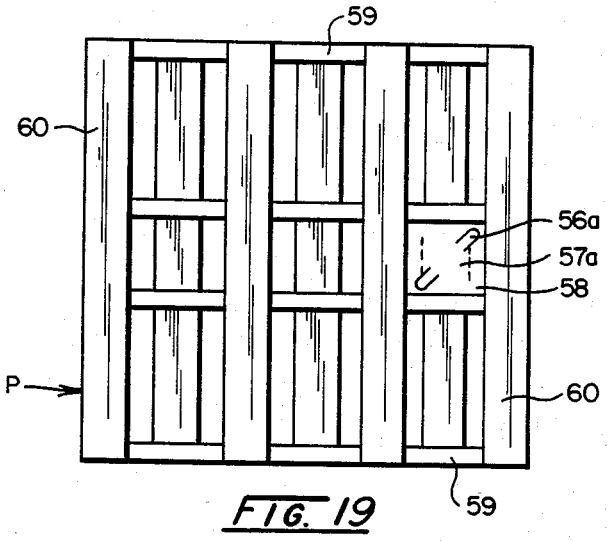
FIG. 19 is a bottom view of the assembly of FIG. 18.
Figure 19A:
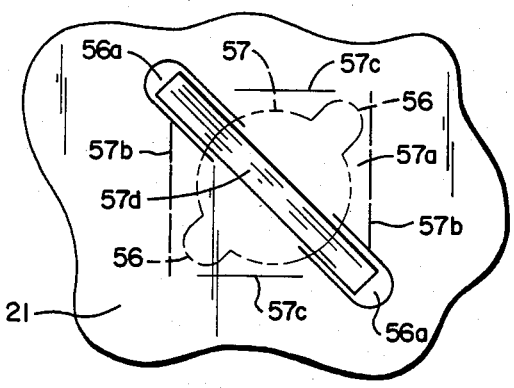
FIG. 19A is a detail of the bottom dispensing opening.
Figure 20:
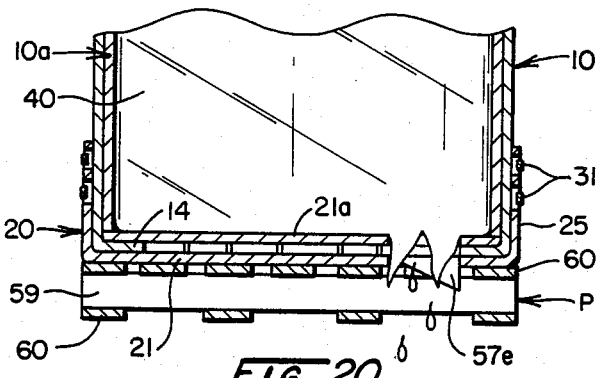
FIG. 20 is a view similar to FIG. 18 showing the bag being emptied.

Sometimes it may be desirable to dispense from the container by rupturing the bottom of the bag, as shown in FIGS. 18 to 20. If so, the tearout portions 57*a* and 57 are removed from both the bottom discs 21 and 21*a* to expose directly the bottom of the bag 40 through the pallet opening 58. Then, the bag bottom can be ruptured with a knife to allow the contents to flow by gravity from the bag, as shown in FIG. 20.

The tearout portions 57*a* and 57 of the respective discs 21 and 21*a* are located in superimposed relationship by the spout 42 extended through the opening 53*a* of disc 21*a* and opening 53 of disc 21.

It will be apparent from the above that this invention provides a disposable package assembly which can handle large volumes of heavy liquids or semi-liquids for shipping, storage and ultimate dispensing. The package comprises a fiberboard container assembly which includes a drum-like body that is supplied in flat knocked-down form and end closures which are also supplied in flat knocked-down form. When set up, the lower end of the fiberboard body is telescoped into upstanding flanges of the lower tray and the upper end is telescoped within the depending flange of the upper cap which are held in fixed positions by the preformed circular bands. The assembly also includes the plastic bag which is locked in place within the body by a dispensing spout during filling and, as it is filled, the bag conforms to the drum-like body. However, when filled, the bag will have its upper end spaced below the cap for receiving a spacer-baffle. During setting-up and filling, the fiberboard body resting on the bottom tray, will be disposed on a pallet of special structure. The filled and capped fiberboard container, with the filled bag, is reinforced by rings applied at vertically-spaced intervals to the body and closures and is stabilized on the pallet by means of tension members which are passed vertically over a stabilizing pressure-applying unit or frame resting on the cap and under the pallet, as well as vertically along the sides of the drum-like fiberboard body, and are tightened to apply tension to exert downward pressure axially through the cap, the body, and the bottom tray to hold the fiberboard container assembly on the pallet. Thus, all these members are clamped axially together as a unit. To dispense the contents from the bag, a special probe may be inserted into the dispensing spout to rupture the bag at the inner end thereof or the bottom of the bag may be exposed, through aligning openings in the bottom tray and the pallet, so that the bag bottom can be cut directly.

The above-described assembly makes it possible to use a container assembly of the bag-in-box type for shipping, storage and dispensing large amounts of liquids or semi-liquids of considerable weight, for example three to five hundred gallons, as compared to the ordinary use of the bag-in-box type container which usually handles a maximum of about five gallons. This is made possible by setting up the fiberboard container assembly of drum-like form on a pallet reinforcing it peripherally and securing it to the pallet in upright position by the angularly-disposed tension members at least some of which are in vertical planes at right angles to each other, which clamp the filled fiberboard container assembly axially between the upper stabilizing frame and the supporting pallet so that forces resulting from the tendency of the bag contents to surge, during handling and shipping, will not unduly distort the relatively flexible panel side walls of the fiberboard body of the container but will permit absorption of such forces by these walls. Also, the upper end of the bag is clamped and spaced beneath the cap by a spacer-baffle to prevent undue force on the cap from upward surging of the bag contents. This overall arrangement results in stability of the fiberboard container assembly on the pallet and undue distortion of the container itself. Furthermore, the container assembly can resist axial stacking pressure. Because it is not necessary to return the container for cleaning and re-use, great savings result in labor and freight costs. One person can more readily handle the knocked-down container to prepare it for filling as compared to the large pre-formed containers. Also, the container assembly itself can be supplied at a lower cost.

Having thus described the invention what is claimed is:

1. A container and support assembly including:

a disposable fiberboard assembly comprising a tubular body of fiberboard or the like composed of a plurality of vertical panels hinged together at vertical hinge joints to form a multi-sided polygonal body of tubular form open at both its upper and lower ends which is set up from a blank folded flat at opposed hinge joints, a bottom tray of fiberboard or the like with upstanding flanges hinged to a flat disc-like bottom wall which has an outer polygonal periphery corresponding substantially to that of the tubular body and with flanges hinged thereto at horizontal hinge joints and being set-up from a flat blank with the flanges turned upwardly from the disc-like bottom, at least one surrounding tie-band securing the flanges in upstanding position, said tubular body being telescoped downwardly into the tray with its vertical panels within the corresponding upstanding flanges of the bottom tray and having its lower end resting on the bottom disc-like wall of the tray, a pallet on which said tray disc-like bottom wall rests, a cap of fiberboard or the like with depending flanges hinged to a disc-like top wall which has an outer-polygonal periphery corresponding substantially to that of the tubular body and with flanges hinged thereto at horizontal hinge joints and being set-up from a flat blank with the flanges turned downwardly, at least one surrounding tie-band securing the flanges in depending position, said cap being telescoped downwardly over the upper end of the tubular body with its depending flanges overlapping the corresponding vertical panels of the body and with its disc-like top wall resting on the upper end of the body; and stabilizing means for securing the fiberboard assembly to the pallet comprising tension members at angularly-spaced positions around the tubular fiberboard container body extending completely vertically around the cap and along the vertical panels of the body and tightened and secured to the pallet to clamp these members axially together; said body having a flexible bag therein filled with contents to a level spaced below the disc-like top wall of the cap and a spacer unit between that cap wall and the upper end of the filled bag to apply pressure thereto, said tubular body having flanges at its lower end hinged to the corresponding panels at horizontal hinge joints and turned inwardly horizontally so they will rest on said disc-like bottom wall of the tray, said assembly including a liner disc having an outer polygonal edge complemental to the polygonal shape of the body and inerted axially therein to rest on said horizontal flanges, and a tubular body liner of a polygonal shape like the body set up from a similar flat blank composed of a corresponding number of hinged panels which are disposed in flat contact with the inner surfaces of the corresponding body panels, said liner having a lower edge resting on the liner disc and an upper edge engaging the top disc-like wall of the cap; and a pressure-applying disc in engagement with the upper end of the filled bag and engaged by said spacer unit, said disc having an outer polygonal edge complemental to the liner in which it is inserted, said stabilizing means including an upper stabilizing frame in contact with the flat disc-like top wall of the cap, said frame including frame members disposed in angular relationship across said flat top wall of the cap to provide outwardly-extending arms which extend to the edge of the cap, said pallet being of a size to extend to the edge of the tray, said pallet having an upper support surface and spaces therebeneath, said tension members extending vertically completely around the stabilizing frame along the arms thereof and beneath the support surface of the pallet and through the said spaces thereof.

2. An assembly according to claim 1 in which the spacer unit comprises interlocked fiber panels which are arranged to receive and resist compressive axial forces between the bag upper end and the cap.

3. An assembly according to claim 2 in which the interlocked panels are formed from flat fiberboard blanks scored and slit and folded into channel shapes which are arranged transversely relatively, and vertically reversed to interlock at the slits.

4. An assembly according to claim 1 in which the upper stabilizing frame is of substantially H-form and includes a pair of laterally-spaced parallel slats extending across the top wall of the cap and disposed just laterally outwardly of opposed depending flanges thereof, and a single slat disposed at right angles to the pair of slats and extending across the top wall of the cap so that it is intermediate the opposing depending flanges thereof, a single tension member extending over the latter slat and vertically along the corresponding opposed panels of the body as well as beneath the pallet, and a pair of tension members extending over the first-mentioned pair of slats and extending vertically just laterally outwardly of the hinge points of the opposed panels of the body and beneath the pallet.

5. An assembly according to claim 4 in which the pallet is formed of support rails which carry upper slats that form said support surface and lower slats, said rails including a central pair disposed in parallel relationship and in vertical planes just within the vertical planes of said pair of slats so that the tension members cooperating therewith will pass through said pallet just laterally outwardly of said rails.

6. An assembly according to claim 5 in which the flexible bag with the desired liquids or semi-liquids contents is disposed within said body on said bottom tray, said bag being closed at its top to provide the space between the closed top and the disc-like top wall of the cap to receive said spacer unit said bag being tied at its upper and and said pressure disc having a central opening through which said tied end extends.

7. An assembly according to claim 6 in which the bag has a dispensing spout at its lower end, said spout projecting through aligning openings in one of the body panels and an overlapping upstanding flange of the bottom tray, and means for locking the spout in that position.

8. An assembly according to claim 7 in which the inner end of the spout is sealed by the bag wall itself, and a probe inserted in the spout rupturing said bag wall at said spout to permit dispensing.

9. An assembly according to claim 7 in which the body liner has an opening in one of its panels for receiving the spout, said liner disc having an upstanding tab which also has an opening for receiving the spout.

10. An assembly according to claim 9 in which said bottom disc and said liner disc have tear-out portions aligned by the spout passing through said openings in the liner disc tab and the upstanding flange of the bottom tray.

11. An assembly according to claim 10 in which the pallet has an opening to expose said tear-out portions in the disk-like bottom wall of the tray and liner disc.

12. An assembly according to claim 7 in which the bottom tray has vertically-spaced reinforcing rings holding said upstanding flanges in position over the upstanding panels of the body.

13. An assembly according to claim 12 in which the body has reinforcing rings applied thereto at vertically-spaced levels to a level above the midpoint in the height of the body.

14. The method of packaging bulk material in a disposable fiberboard container assembly which comprises:

providing a pallet which has a support surface, setting up on the support surface a bottom tray from a flat blank of fiberboard or the like by turning upwardly flanges hinged to the polygonal periphery of a flat disc-like bottom at horizontal hinge joints, applying at least one tie-band to hold such flanges in upstanding position, setting up from a flat blank a tubular body of fiberboard or the like composed of a plurality of panels hinged together at vertical joints to form a multi-side polygonal body open at both its upper and lower ends and having panels corresponding in number and position to the upstanding flanges of the tray so it is of complemental polygonal form and inserting its lower end downwardly into the tray with its panels in face contact with corresponding upright flanges of the tray and with the lower end of the body resting on the disc-like bottom of the tray, placing a flexible bag in the body of the tray and supplying it with the desired contents, closing the upper end of the bag, placing a compression-receiving spacer above the upper end of the bag, but filling the bag before applying the spacer to such an extent and closing it so that there is a void in the body between the closed upper end of the bag and the flat disc-like top of the cap for receiving the spacer and positioning a pressure-applying disc on the bag and upon which the spacer is supported, setting up a cap from a flat blank of fiberboard or the like by turning downwardly flanges hinged to the polygonal periphery of a flat disc-like top wall, the polygonal periphery corresponding to the polygonal shape of the tubular body, applying at least one tie-band to hold such flanges in depending position, telescoping the cap over the upper end of the tubular body with its flanges, which correspond in number and position to the panels of the body, overlapping such panels, and stabilizing the fiberboard assembly on the pallet by passing tension members at angularly-spaced positions around the tubular fiberboard container body to extend completely vertically around the cap and along the vertical panels of the body and tightening and securing them to the pallet to clamp those members axially together with the spacer contacting the upper end of the bag and the top wall of the cap and with a flat stabilizing frame applied to the top surface of the disc-like topwall of the cap with arms extending in angularly-spaced positions to the depending flanges at the polygonal edge of the cap, with said tension members extending over the arms of said frame, downwardly along the vertical panels of the body and beneath the pallet, said stabilizing frame being of substantially H-form and comprising arm members extending at right angles relatively so that the tension members will pass around the assembly at right angles to resist forces on the assembly exerted from various angular positions.

15. The method of claim 14 in which the spacer is set up from scored and slit flat blanks folded into channel form and interlocked to provide a compression transmitting unit.

16. The method according to claim 14 in which the bag is provided with a dispensing spout at its lower end which is extended through the lower end of a body panel and an overlapping flange of the tray and is locked in that position.

17. The method according to claim 14 including dispensing the contents of the bag by inserting a probe through the spout and rupturing a portion of the bag which seals the spout.

18. The method according to claim 14 including dispensing the contents of the bag by providing an opening in the pallet and a corresponding opening in the bottom disc of the tray to expose the bag bottom where it is ruptured.

19. The method of packaging bulk material in a disposable fiberboard container assembly which comprises:

providing a pallet which has a support surface, setting up on the support surface a bottom tray from a flat blank of fiberboard or the like by turning upwardly flanges hinged to the polygonal periphery of a flat disc-like bottom at horizontal hinge joints, applying at least one tie-band to hold such flanges in upstanding position, setting up from a flat blank a tubular body of fiberboard or the like composed of a plurality of panels hinged together at vertical joints to form a multi-side polygonal body open at both its upper and lower ends and having panels corresponding in number and position to the upstanding flanges of the tray so it is of complemental polygonal form and inserting its lower end downwardly into the tray with its panels in face contact with corresponding upright flanges of the tray and with the lower end of the body resting on the disc-like bottom of the tray, placing a flexible bag in the body of the tray and supplying it with the desired contents, closing the upper end of the bag, placing a compression-receiving spacing in contact with the upper end of the bag, setting up a cap from a flat blank of fiberboard or the like by turning downwardly flanges hinged to the polygonal periphery of a flat disc-like top wall, the polygonal periphery corresponding to the polygonal shape of the tubular body, applying at least one tie-band to hold such flanges in depending position, telescoping the cap over the upper end of the tubular body with its flanges, which correspond in number and position to the panels of the body, overlapping such panels, and stabilizing the fiberboard assembly on the pallet by passing tension members at angularly-spaced positions around the tubular fiberboard container body to extend completely vertically around the cap and along the vertical panels of the body and tightening and securing them to the pallet to clamp those members axially together with the spacer contacting the upper end of the bag and the top wall of the cap, the tension members being passed over a pressure-applying unit in contact with the top surface of the flat disc-like top wall of the cap along tension-supporting portions thereof, which extend to the edge of the cap, and then downwardly along the vertical panels of the body and beneath the pallet, at least some of said tension members being in vertical planes at right angles to each other.

20. The method of claim 19 in which said pallet has an upper support surface and spaces therebeneath, said tension members extending completely across the stabilizing unit along the support portions thereof and beneath the support surfaces of the pallet and through the spaces thereof and including a single tension member extending across the stabilizing unit and vertically along opposed panels of the body and beneath the pallet, and a pair of tension members extending across the stabilizing unit and vertically along and just laterally outwardly of the hinge joints of the opposed panels of the body and beneath the pallet.

* * * * *